United States Patent [19]

Heiberger

[11] Patent Number: 4,593,547

[45] Date of Patent: Jun. 10, 1986

[54] HYDRAULIC OVERLOAD CONTROL SYSTEM FOR POWER PRESSES

[75] Inventor: Francis E. Heiberger, Elmhurst, Ill.

[73] Assignee: Danly Machine Corporation, Chicago, Ill.

[21] Appl. No.: 748,971

[22] Filed: Jun. 26, 1985

[51] Int. Cl.[4] ..... B21D 55/00

[52] U.S. Cl. ..... 72/1; 72/19; 72/26

[58] Field of Search ..... 72/1, 8, 19, 20, 21, 72/26, 27, 352

[56] References Cited

U.S. PATENT DOCUMENTS

| | | | |
|---|---|---|---|
| 3,165,140 | 1/1965 | Hazelton | 72/26 |
| 3,760,249 | 9/1973 | Connors | 72/26 |
| 3,783,662 | 1/1974 | Keller | 72/1 |
| 4,026,204 | 5/1977 | Good | 72/26 |

*Primary Examiner*—Leon Gilden

*Attorney, Agent, or Firm*—Leydig, Voit & Mayer, Ltd.

[57] ABSTRACT

A hydraulic overload control system for a mechanical power press having a flywheel driven eccentric shaft and one or more pitmen drivingly coupled to the eccentric shaft. The press has a slide drivingly coupled to the pitmen by corresponding hydraulic piston and cylinder connections. The overload control system includes means for generating a first electrical signal having a value proportional to the force exerted on the die by the slide throughout the work stroke thereof; means for generating a second electrical signal having a value proportional to the position of the slide throughout the work stroke; means for storing the maximum tonnage capacity values of the press at a multiplicity of slide positions throughout the work stroke; control means responsive to the second electrical signal for retrieving the stored value representing the maximum tonnage capacity of the press at the slide position represented by the second signal; means for comparing the retrieved value corresponding to the second signal with the value of the first signal to determine whether the press is in an overload condition; and means responsive to the determination of an overload condition at any point in the work stroke for actuating the clutch and break interlock mechanism of the press to stop movement of the slide.

16 Claims, 9 Drawing Figures

HYDRAULIC OVERLOAD CONTROL SYSTEM FOR POWER PRESSES

FIELD OF THE INVENTION

The present invention relates generally to mechanical power presses and more particularly to an improved hydraulic overload control system for such presses.

BACKGROUND OF THE INVENTION

The problem of overloading in mechanical power presses has received much attention over a period of many years. Such presses utilize a portion of the energy stored in a flywheel to actuate a mechanical linkage which moves the slide through its work stroke and thereby shapes the material in the die. Because of the excess energy available in the flywheel, mechanical interference encountered during the work stroke of the slide can produce undue stress on the components of the press. Such interference may be due to a variety of causes, among which are the presence of a tool or other foreign item left in the die, improper adjustment of the die, feeding of material which exceeds the thickness for which the die has been adjusted, and many other causes.

As mechanical interference is encountered, the press will attempt to complete the work stroke of the slide utilizing stored energy from the flywheel. Since the stored energy in the flywheel is substantially greater than that which is required for the work stroke, the dissipation of excess stored energy will create destructive stress on the gears and drive linkages of the press. As a further consequence, such interference may also severely damage the die.

Systems which prevent the attempted completion of the work stroke of the press once mechanical interference has been encountered are known in the prior art. The following U.S. patent and publication are illustrative:

U.S. Pat. No. 2,937,733, Issued: May 24, 1960, Inventor: James C. Danly.

*Hydraulic Overload Systems*—Francis E. Heiberger, (*Understanding Presses and Press Operations,* pp. 166–170, Copyright 1981, Society of Manufacturing Engineers).

In both of these prior systems, a hydraulic piston and cylinder connection is interposed between the slide and a driving pitman of the press. As mechanical interference is encountered during the work stroke, the force between the pitman and the slide increases, leading to a corresponding increase in pressure inside the hydraulic cylinder. When this pressure exceeds a predetermined value corresponding to the estimated tonnage capacity of the press, a relief/dump valve lowers the hydraulic pressure in the cylinder and a pressure switch is actuated to stop the press.

During the work stroke, the capacity of the press does not remain constant, but varies with the angular position of the eccentric shaft and the corresponding vertical displacement of the slide. At the half-way point of the work stroke, when the eccentric is at a 90° angle with respect to its lower dead center position, the capacity of the press is considerably less than when the eccentric is in the lower dead center position. Since the press capacity varies in this manner, the use of a single estimated value of the tonnage capacity of the press to establish the existence of an overload condition can only provide a first approximation as to when an actual overload condition occurs. If the system uses an estimated tonnage capacity corresponding to the tonnage capacity near the bottom of the work stroke position, mechanical interference encountered by the press before reaching that particular position will necessarily overload the press before the system can detect the overload condition. Moreover, if the estimated tonnage capacity used as a reference for overload is that which would overload the press during the beginning of the work stroke, the control system may indicate the presence of an overload condition when no such condition actually exists.

SUMMARY OF THE INVENTION

It is therefore an object of the present invention to provide an improved hydraulic overload control system for a mechanical power press and which is adapted to determine the existence of an overload condition by continually evaluating the maximum tonnage capacity of the press during the work stroke of the slide.

Another object of the present invention is to provide a system of the foregoing character which is adapted to continuously measure the capacity of the press so that press efficiency may be maximized without jeopardizing the structural integrity of the press. In this connection, a related object of the invention is to increase the production efficiency of manufacturing operations through the use of presses equipped with the present invention.

A further object of the invention is to provide a system of the type set forth above having means for instantly relieving the overload stress on the mechanical components of the press due to mechanical interference at any point during the work stroke of the press.

Another object of the present invention is to eliminate the need for repair and replacement of overstressed gears and linkages in a mechanical power press, and to minimize press downtime after an overload condition occurs.

A further object of the invention is to minimize overdesign of a power press in order to maintain structural integrity of the press when mechanical interference is encountered.

Other objects and advantages of the invention will become apparent from the following detailed description, taken together with the accompanying drawings.

In keeping with the objects set forth above, the hydraulic overload control system of the present invention comprises means for continuously generating a first electrical signal proportional to the force exerted on the die by the slide during the work stroke; means for generating a second electrical signal proportional to the angular position of the eccentric and the linear position of the slide; and means for converting the first and second electrical signals into a third electrical signal adapted to stop the movement of the slide in the event of an overload.

Figure 1:
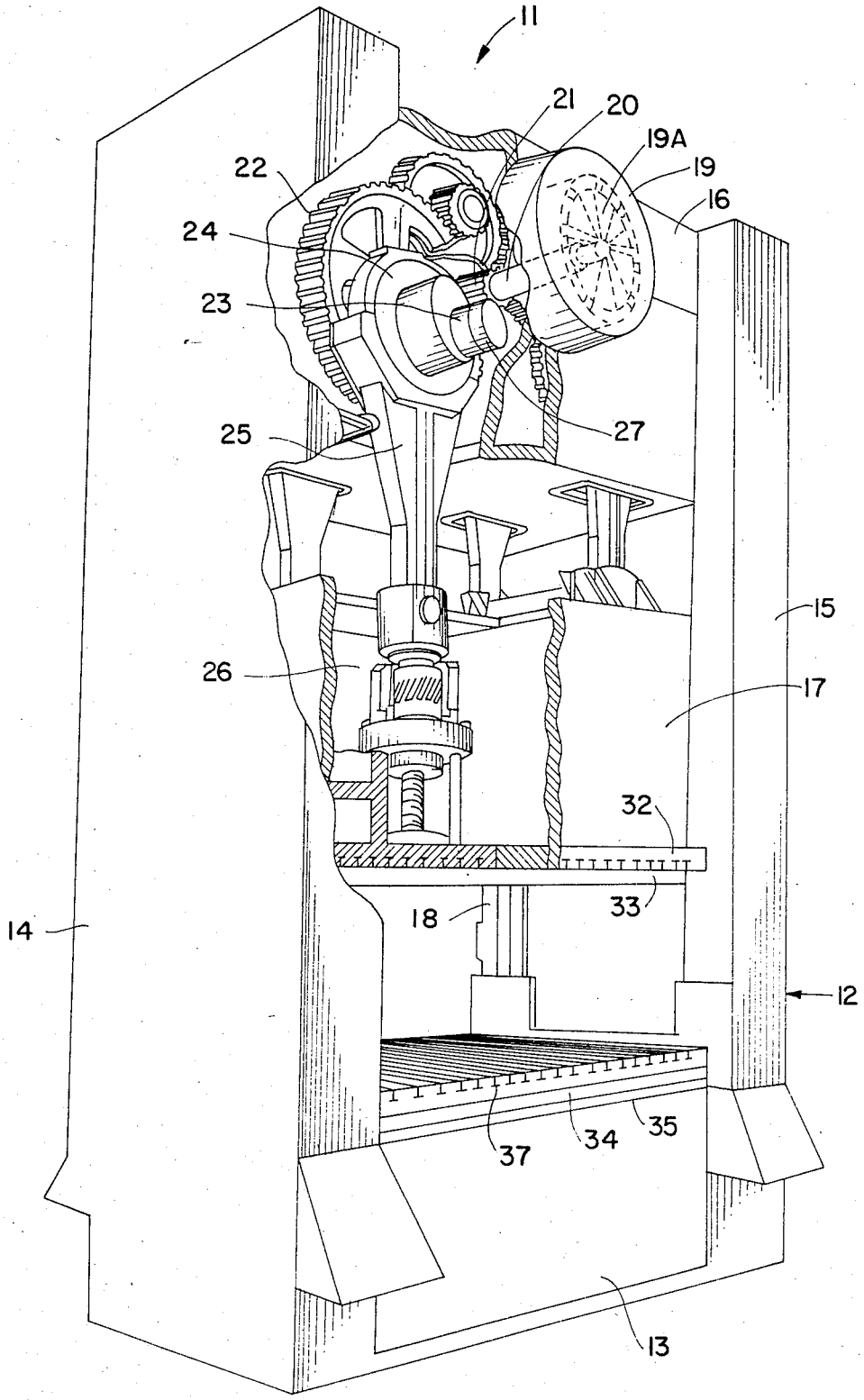
FIG. 1 is a perspective view of a mechanical power press embodying the present invention with a die mounted therein.

While the invention is susceptible of various modifications and alternative constructions, a specific embodiment thereof has been shown by way of example in the drawings and will be described below in considerable detail. It should be understood, however, that there is no intention to limit the invention to the specific form disclosed but, on the contrary, the intention is to cover all modifications, alternative constructions, and equivalents falling within the scope of the appended claims.

DESCRIPTION OF THE PREFERRED EMBODIMENT

Referring more specifically to FIG. 1, the invention is there exemplified in a hydraulic control system for a mechanical power press 11 which in this instance happens to be of the single action, fourpoint suspension type. FIG. 1 shows a cut-away view illustrating the components of one of the four points of the press. The press 11 has a main frame 12 which comprises a bed 13, a pair of laterally spaced uprights 14, 15, and a crown 16. A slide 17 is mounted for vertical reciprocating movement in a guideway defined by a plurality of gibs 18 fixed to the frame uprights 14, 15.

The press 11 is powered from a large motor driven flywheel 19 in the crown 16. A clutch and brake interlock mechanism 19A is mounted axially on the flywheel and is adapted to arrest the movement of the slide 17. The flywheel is mounted on a drive shaft 20 journalled in the lower portion of the crown and delivers power through a differential drive arrangement to each of the four press points in the following manner. For each of the four press suspension points, the shaft 20 has a pinion 21 fixed thereto and disposed in meshed engagement with a main drive gear 22. The latter is keyed or otherwise fixed to a shaft 23 journalled in the crown and forming an eccentric 24. The eccentric 24 has a pitman 25 drivingly connected thereto and pivotally coupled at its lower end to a hydraulic connection 26 on the slide. The shaft 23 on which the eccentric 24 is located, has a rotary transducer 27 positioned on one end. The transducer monitors the angular motion of the eccentric 24 and hence the pitman 25 and transduces it into an analog signal which is directly proportional to the angular position of the eccentric at any given point during the prior stroke. The importance of such a transduced signal will be described below.

The slide 17 is a heavy walled box-like structure slidably mounted in the gibs 18 on the press frame (FIGS. 1 and 4) and reinforced with internal partition walls 28. Its connection 26 with each of the four pitmen is conventional and comprises a hydraulic cylinder 29 rigidly fixed to the slide and a piston 30 slidably mounted therein. Such a connection is described in detail below with reference to FIG. 4.

Figure 2:
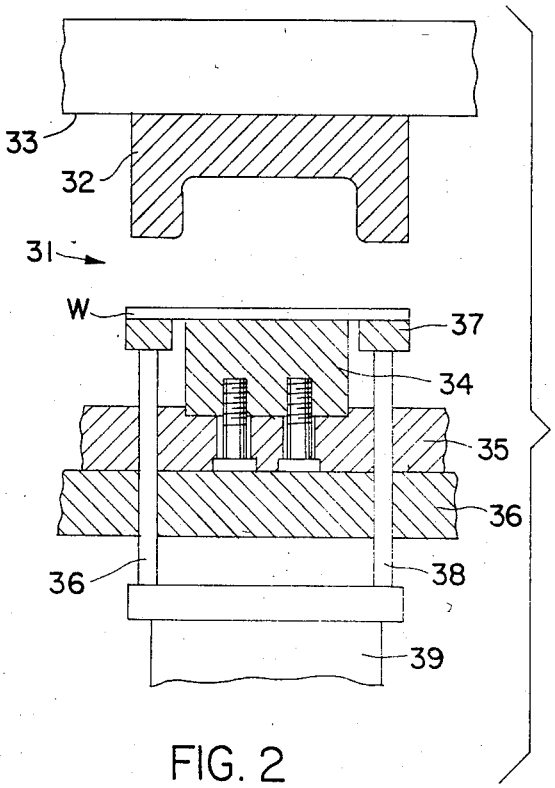
FIG. 2 is a vertical sectional view taken transversely through the die of the press shown in FIG. 1 prior to the start of a work stroke.
Figure 3:
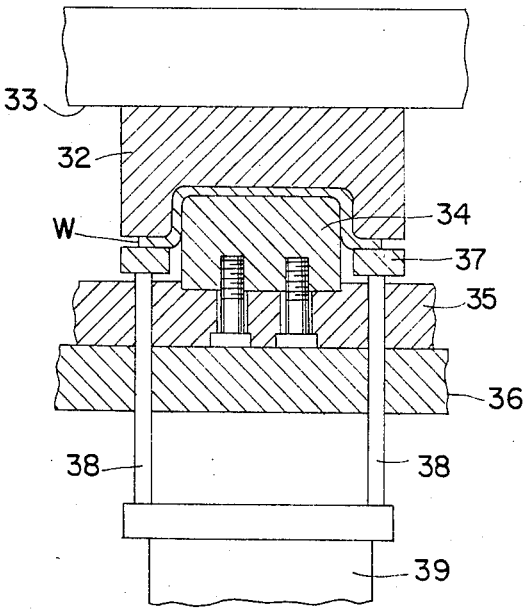
FIG. 3 is a transverse vertical sectional view similar to FIG. 2 but showing the die upon completion of the work stroke of the slide.

The press 11 is equipped in this instance with a die 31 for shaping a workpiece from a blank of flat steel plate W (FIGS. 1, 2 and 3). The die 31 comprises an upper die 32 fixed to a mounting surface 33 on the underside of the slide, and a lower die having a punch 34 and punch holder 35. The latter are mounted on a bolster 36 fixed to the press bed 13. The punch 34 is surrounded by a pressure ring 37 resiliently supported on pressure pins 38 connected to a die cushion 39 in the lower part of the bed.

Figure 4:
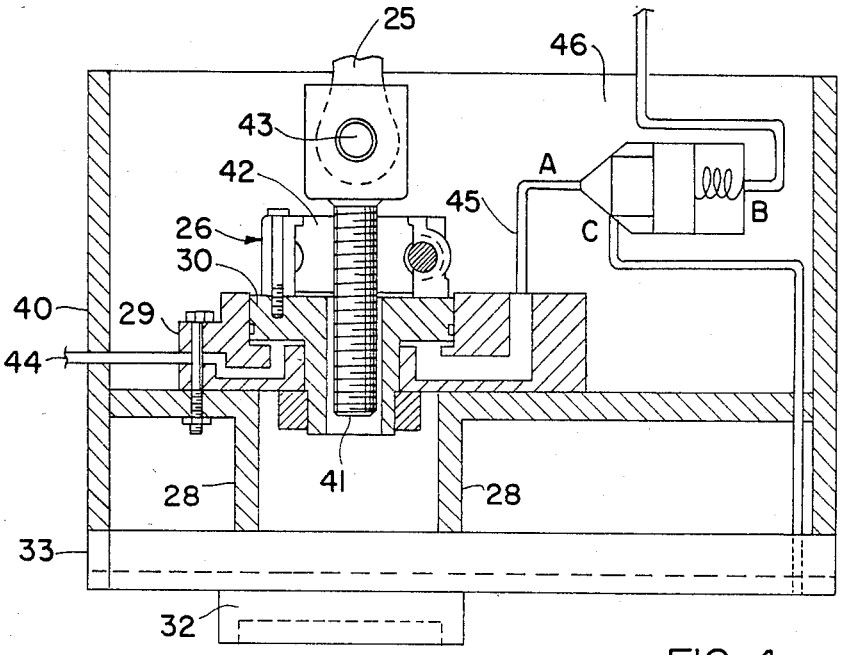
FIG. 4 is a diagrammatic view illustrating the hydraulic overload system as applied to one of the suspension points of the slide.

FIG. 4 illustrates the hydraulic connection between the pitman and the vertical slide at one of the four points of the four-point press.

The connection 26 is housed within the heavy walls 40, the mounting surface 33 and the internal partition walls 28 of the slide, and basically consists of a hydraulic cylinder 29 rigidly fixed to the slide and a piston 30 slidably mounted therein which carries an adjusting screw 41 and an associated adjusting nut 42. The lower end of the pitman 25 is pivotally coupled to the adjusting screw 41 by means of a wrist pin 43.

Pressurizing oil enters the hydraulic connection via an input port 44 and exits via an output port 45. The output port 45 is directly connected to end A of a two-way poppet valve 46 whose operation is discussed below with reference to FIG. 5.

In accordance with the present invention, an improved overload control system for a mechanical power press includes an overload control valve in communication with the hydraulic cylinder, the valve having a pressure transducer associated with it for generating an electrical signal representing the fluid pressure generated inside the cylinder due to the motion of the slide, means for storing the maximum tonnage capacity values of the press at a multipicity of slide positions throughout the work stroke, control means responsive to the press slide position-indicating signal for retrieving the stored values representing the maximum tonnage capacity of the press at the slide position represented by the position signal, means for comparing the retrieved value with that of the pressure signal to determine whether the press is in an overload condition, and means responsive to the determination of an overload condition at any point in the work stroke for actuating the clutch and brake interlock mechanism to stop movement of the press slide.

The overload system according to the present invention determines the existence of an overload by continually evaluating the maximum tonnage capacity of the die and the press throughout the work stroke of the slide. In this way, the invention avoids the use of a single reference value for determining whether an overload condition occurs, and makes it possible to precisely determine the presence of an overload condition at any point in the slide work stroke. Since the system of the invention is able to precisely identify an overload condition at any point in the work stroke, the components of the press do not have to be overdesigned to accommodate extra stresses expected as a result of imprecise determination of the existence of an overload condition. In addition, because the tonnage capacity of the die and the press are continuously determined, the press may be operated to its full capacity without risking its structural integrity.

Since the presence of an overload at any point in the work stroke is accurately determined, the chance of deforming or breaking press components is reduced substantially. The down time associated with replacing such components, and the resulting cost, is accordingly reduced.

In the illustrative embodiment of the invention, the end B of the poppet valve 46 leads to a pressure transducer 47 (FIG. 5), while the end C is connected to the oil reservoir. The piston 30 is adapted to move axially of the cylinder a distance on the order of one inch or more. A column of pressurized oil supplied through the input port 44 is maintained within the cylinder 29 so as to hold the piston 30 at the upper end of its stroke. A low pressure hydraulic pump supplies pressurized oil to the input ports 44 of each of the four hydraulic connections through a common header.

In FIG. 4, the pivotal connection between the lower end of the pitman 25 and the adjusting screw 44 permits the translation of the rotary motion of the pitman into the vertical motion of the piston 30 within the hydraulic cylinder 29. As the angular position of the pitman changes, the load conditions encountered by the slide also change and this produces a corresponding change in the oil pressure in the hydraulic connection 26. This change in the oil pressure is reflected across the poppet valve 46 at the output port 45 of the connection and is in turn continuously monitored by the pressure transducer 47 (FIG. 5).

Figure 5:
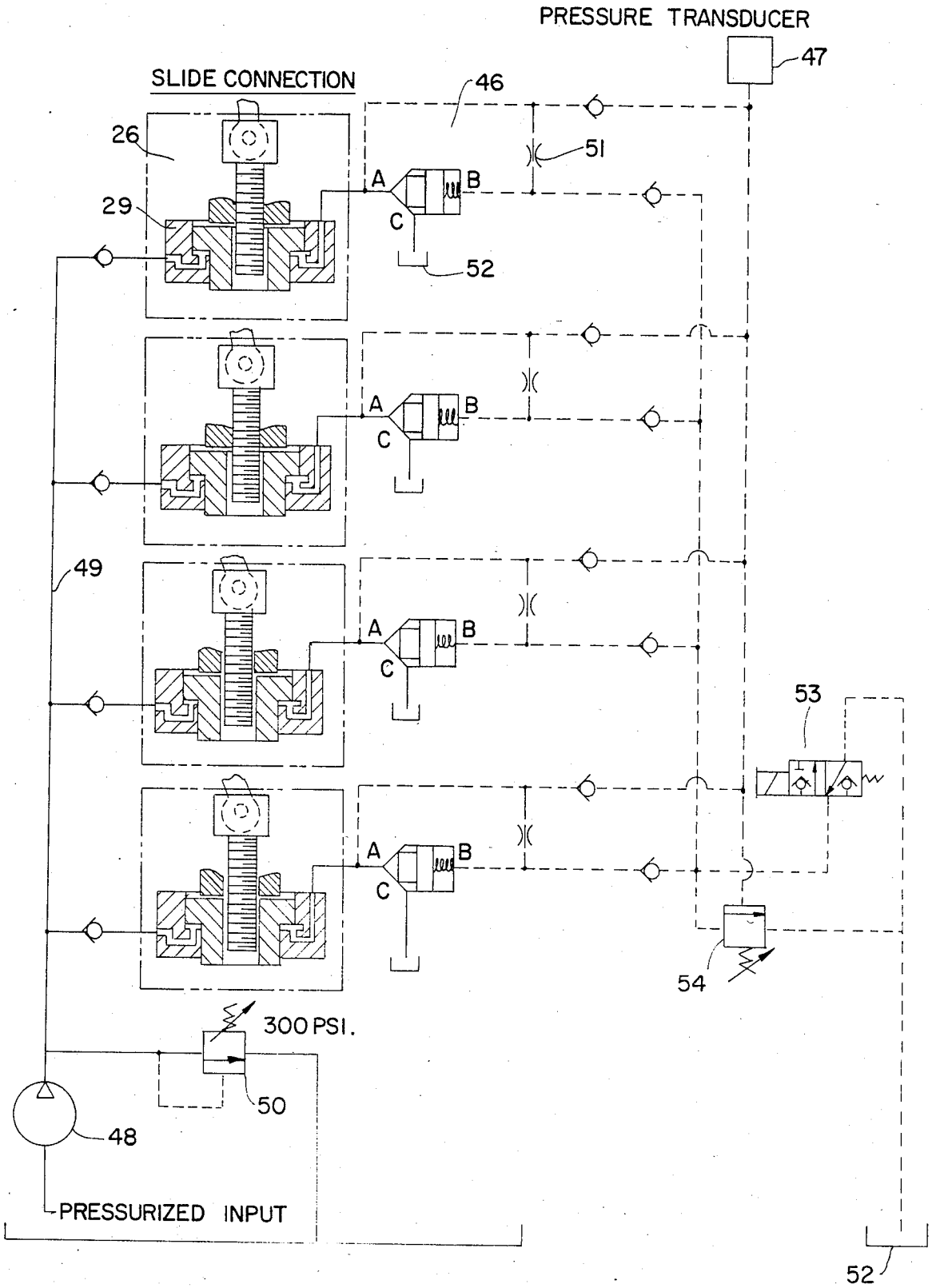
FIG. 5 is a schematic diagram of the hydraulic circuit of a hydraulic overload system embodying the present invention for use in the press of FIG. 1.

Referring more particularly to FIG. 5, it will be noted that fluid for the hydraulic overload control system is supplied by a low pressure hydraulic pump 48 to a header 49 leading to the four hydraulic connections 26 on the slide. The initial pressure in the header 49 is set by a relief valve 50 which is typically set at 300 psi.

Each hydraulic connection 26 is connected to a two-way poppet valve 46 which communicates directly with the cylinder 29 of the hydraulic connection and the pressurized column of oil therein, through end A of the valve. The hydraulic connection 26 itself has been described in detail above with reference to FIG. 4. In FIG. 5, the poppet valve 46 is designed with an area ratio such that the area of the poppet at end B is larger than the area at end A by a predetermined amount. Typically, the area ratio for the poppet valve is 1.33:1. Control pressure from the connection side is also supplied to end B of the poppet valve through an orifice 51. Hence at the top of the press stroke, in the absence of loading conditions, the poppet on valve 46 remains seated and oil from the connection cannot escape. During the actual work stroke of the press, the oil pressure within the hydraulic connection 26 is increased and can exceed the system pressure because of the restraining action of the poppet valve 46.

The poppet valve 46 remains closed under no-load conditions and prevents the oil from the hydraulic connection 26 from escaping. But as the vertical slide of the press starts its downward path and encounters load, oil pressure in the connection rises to correspond to the load. In other words, the oil pressure in any of the hydraulic connections 26 will be directly proportional to the external load encountered at the connection. A pressure transducer 47 functions to monitor, on a continuous basis, the constantly changing pressure due to the load; and a solenoid-operated relief valve 52 is arranged to discharge the oil column of the cylinder 29 upon receipt of an overload signal.

The rotary transducer 27 (See FIG. 1) on the press monitors the angular position of the driving pitman. The corresponding data from the angular position vs. safe tonnage capacity graph (see detailed description below with reference to FIG. 6) is supplied as command input to a microprocessor (see FIG. 7). The microprocessor compares the allowable pressure from the command input against the actual pressure sensed by the pressure transducer 47 at any particular instant. Whenever the actual pressure is higher than the allowable pressure at any given angular position of the pitman, an electrical signal is produced by the microprocessor of FIG. 7. This electrical signal is used as an overload control signal means in two different ways.

First, any time the actual pressure as sensed by the transducer 47 is deemed to exceed the maximum allowable pressure at any given angular position of the pitman, i.e., any time an overload condition is detected, the resulting overload control signal from the microprocessor is directly used to cause actuation of the clutch and brake interlock to stop the press. Any further movement of the slide 19 is prevented, thus reducing or eliminating destructive stress on the mechanical components of the press 11.

Secondly, the excess pressure in the slide-connection cylinders 29 is automatically relieved upon the occurrence of an overload condition, thereby preventing any damage to the press during the interval required to stop the press or at least eliminate the overload condition. In the illustrative embodiment, the same overload control signal that actuates the clutch and brake interlock in response to an overload condition is utilized to activate a solenoid-operated control valve 53 which connects the control line to the reservoir 52. This produces oil flow through the orifices 51, resulting in a pressure drop which unbalances the forces on the poppet valves, causing them to open. This allows the pressurized oil from the slide connection cylinders 29 to drain to the reservoir at a high flow rate, thereby quickly relieving the overload on the press.

After the overload condition has been alleviated, the actual-pressure signal drops below the allowable-pressure signal again, thereby deactivating the solenoid-operated control valve 53. Thus the control line is no longer connected to the reservoir, oil no longer flows through the orifices 51, and the forces on the poppet valves 46 once again hold them in their closed positions. When movement of the press slide resumes, the pressure in the control line is again modulated in direct proportion to the actual load on the press.

To protect the press against malfunctions in the overload control system, the hydraulic system also includes a relief valve 54 which is set to the rated load capacity of the press. If the actual press load reaches this capacity limit without activating the solenoid-operated control valve 53, the relief valve connects the control line to the reservoir 52 to produce the same pressure-relieving action described above, but only at the single load limit represented by the setting of the relief valve 54.

Figure 6:
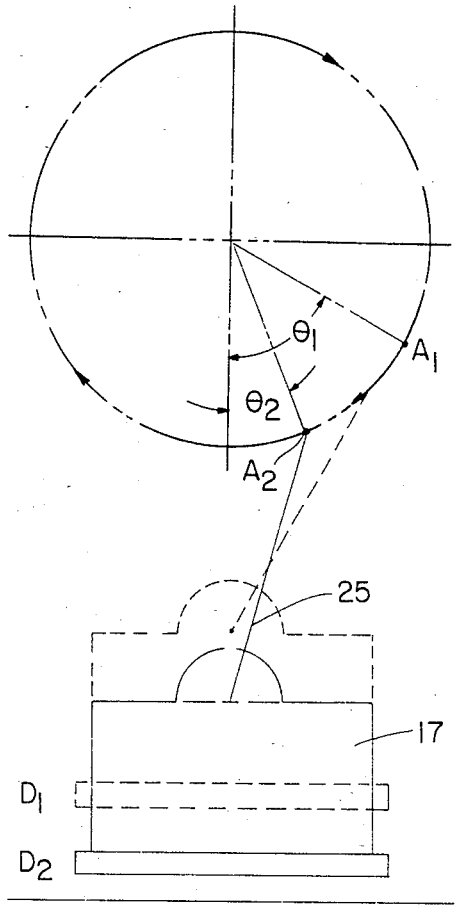
FIG. 6 is a diagrammatic view relating the linear position of the slide to the angular displacement of the eccentric.

As mentioned previously, the rotary transducer 27 on the outer end of the eccentric shaft 23 of the press 11 is used to indicate the rotational displacement of the eccentric shaft 23, and the eccentric 24, during the press cycle. As illustrated in FIG. 6, the movement of the eccentric from point $A_1$ to point $A_2$ corresponds to a rotational displacement of the eccentric from angle $\theta_1$ to angle $\theta_2$. The movement of the eccentric from point $A_1$ to point $A_2$ therefore corresponds to a movement of the base of the slide from a position $D_1$ to a position $D_2$. Accordingly, any movement of the slide can be measured by the rotary displacement of the eccentric 24, as indicated by the rotary transducer 27.

Figure 7:
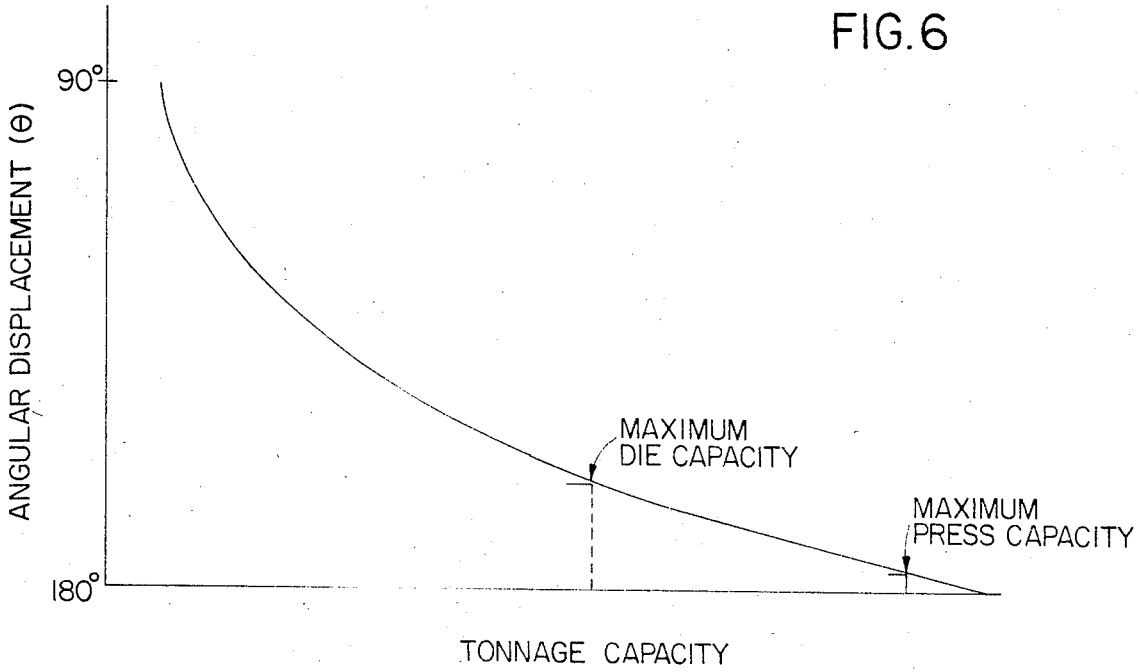
FIG. 7 is a graph indicating the relation between the angular displacement of the eccentric and the tonnage capacity of the press.

FIG. 7 is a graphical representation of the variation in the tonnage capacity of the press as a function of the angular displacement of the eccentric. As shown, the tonnage capacity of the press varies with the angular displacement of the eccentric 24. The tonnage capacity of the press exponentially increases as the angle $\theta$ decreases. For example, it is common for a 1000 ton press to have a tonnage capacity of approximately 1000 tons when the angle $\theta$ approaches zero. However, when the angle $\theta$ is at approximately 90°, the corresponding tonnage capacity of the press may be only about 167 tons. This underscores the need for continuous sensing of overload conditions throughout the work stroke of the press.

Figure 8:
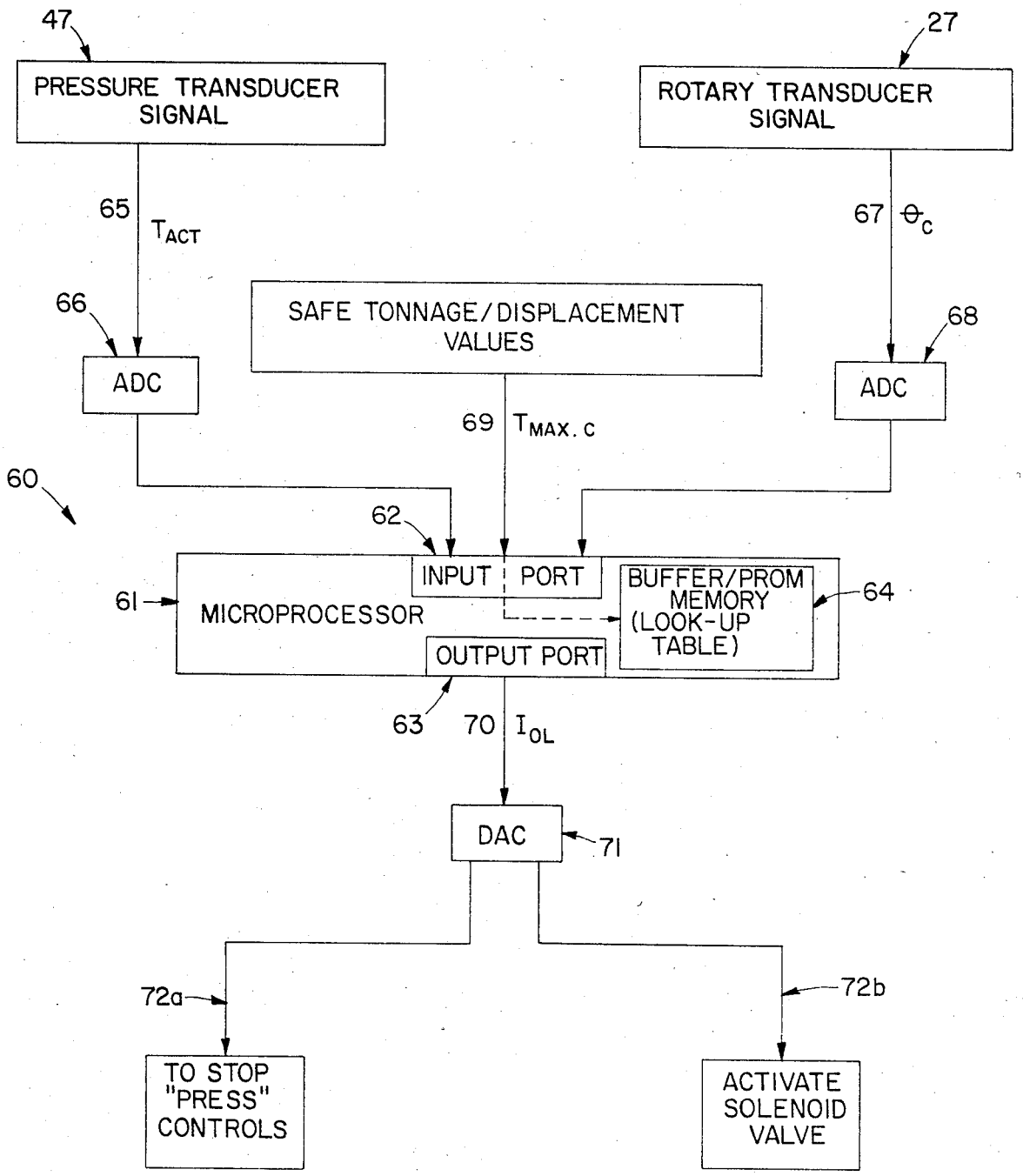
FIG. 8 is a block diagram of the hydraulic overload control system embodying the present invention.

Turning next to FIG. 8, the control system of the present invention is there illustrated in diagrammatic form. The overload control system 60 uses a microprocessor 61 for tracking the desired signals at the input end and producing the required control signal at the output. The microprocessor 61 is conventional and its structure (including the Arithmetic Logic Unit, temporary and permanent registers, program and data memories and Address/Data/Control buses) and function are commonly known in the state of the art. It suffices to mention here that the microprocessor 61 has an input port 62 which accepts all signals involved with the actual processing, an output port 63 through which the results of the processing are communicated externally and a temporary memory (internal or external) 64 which serves as a storage area for the parameters required for comparison purposes described below.

The input port 62 in this case is programmed to accept three input signals. The first signal is derived from the pressure transducer of FIG. 4. This analog transducer signal 65 passes through an analog-to-digital converter 66 before entering the microprocessor 61. The second signal 67 is derived from the rotary transducer 27 of FIG. 1. This analog transducer signal 67 passes through an analog-to-digital converter 68 before entering the microprocessor 61. The third signal 69 controls the storage of the various predetermined maximum allowable tonnage values corresponding to incremental positions along the angular motion of the eccentric on the pitman of the press. These values may be manually fed into the microprocessor's buffer memory 64 just before press operation. Alternatively, these tonnage/displacement values may be pre-programmed into a programmable read only memory associated with the microprocessor so that they are easily accessible during press operation. In both these cases the tonnage/displacement values 69 are arranged within the microprocessor memory in the form of a conventional look-up table so that comparisons may be made easily.

The microprocessor 61 is programmed to use the digital value of the rotary transducer signal 67 as an index into the look-up table and retrieve the corresponding value of the maximum allowable tonnage capacity stored therein. The microprocessor then compares this value with the digital value of the pressure transducer signal 65. If the sensed signal is found to exceed the retrieved tonnage capacity the microprocessor 61 produces an overload control signal 70 ($I_{OL}$) along its output port 63. This signal 70 then passes through a digital-to-analog converter 71 and the resulting analog control signal is used for two functions; (i) the control 72*a* of the brake and clutch interlock mechanism of the press for stopping the motion of the slide and (ii) the activation 72*b* of the solenoid valve for discharging the pressure fluid from the hydraulic connection in order to relieve the pressure built up due to an overload condition.

Figure 9:
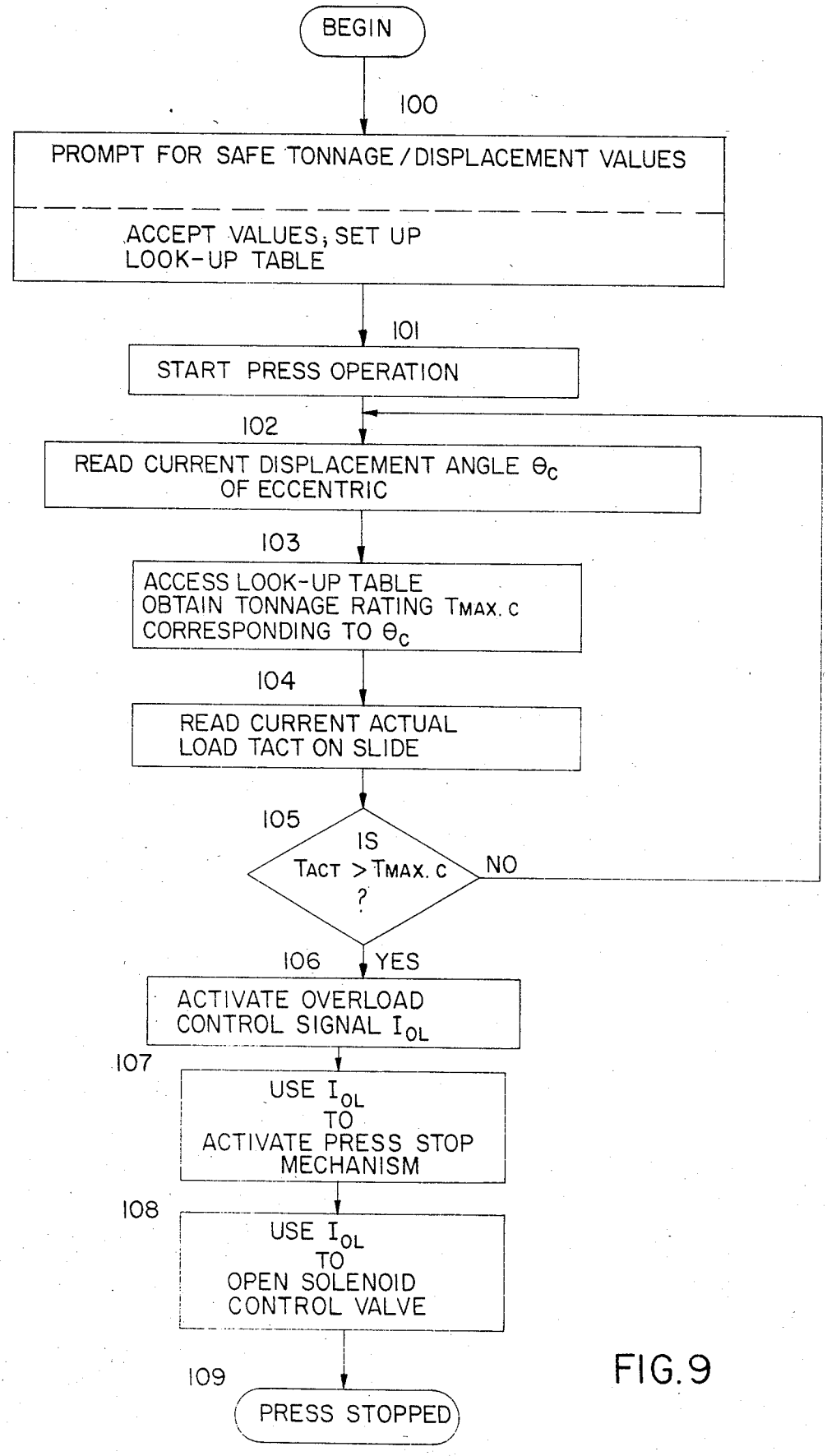
FIG. 9 is a flow chart outlining one exemplary program which may be used to control the operation of the system embodying the present invention.

FIG. 9 is a flow chart illustration of one exemplary software program for controlling the overload protection system described above.

The program begins at step 100 where the system prompts the user for values of maximum allowable tonnage for discrete displacement points along the angular motion of the eccentric 24 on the pitman 25. As described above with reference to FIG. 7, the tonnage capacity of the press varies in proportion to the angular displacement of the eccentric 24. Step 100 involves the feeding into the microprocessor buffer memory of the maximum allowable tonnage values corresponding to discrete points at predetermined increments along the angular motion of the eccentric, as the vertical slide goes through a complete press stroke. These values, after being accepted in response to the prompt, are then arranged in the form of a look-up table which can be used easily to compare relevant values at a later stage. Alternatively, these tonnage/displacement values can be determined and stored ahead of time as a conventional look-up table in a PROM connected to the microprocessor, in which case step 100 can be omitted from the program.

Next is step 101 where normal action of the press is initiated. At step 102 the rotary transducer 27 located on the outer end of the eccentric shaft 23 (FIG. 1) is used to measure the rotational displacement $\theta_c$ of the eccentric shaft 23 and hence the eccentric 24, at any given instant in the press cycle.

At step 103 the microprocessor compares the transduced value $\theta_c$ of the rotary transducer signal to that of the angular displacement values in the stored look-up table and obtains the corresponding value $T_{MAX.C}$ for the maximum allowable tonnage at that particular instant of the press cycle.

At step 104 the program reads the current value $T_{ACT}$ of the load encountered by the slide, i.e., the transduced value, from the pressure transducer of FIG. 5, of the pressure existing within the cylinder of the hydraulic connection, at that particular instant.

Next is step 105 where the microprocessor compares the actual load $T_{ACT}$ at the slide to the maximum allowable tonnage capacity $T_{MAX.C}$. If the actual load $T_{ACT}$ does not exceed the maximum capacity $T_{MAX.C}$, the program reverts to step 102 where the current displacement angle of the eccentric is tracked and the whole process is iterated. If at step 105 it is found that the actual load $T_{ACT}$ indeed exceeds the maximum allowable tonnage capacity $T_{MAX.C}$ step 106 is reached where the microprocessor (FIG. 8) activates an overload control signal $I_{OL}$.

Step 107 is next where the control signal $I_{OL}$ is used to actuate the clutch and brake interlock mechanism to stop the press movement. At step 108 the same overload control signal $I_{OL}$ generated by the microprocessor in response to the overload condition is used to actuate the solenoid operated control valve 53, which in turn relieves the excessive pressure generated in the cylinders of the hydraulic connection. This dissipation of excessive power in the event of an overload condition takes place during the time that the clutch and brake interlock mechanism needs to actually succeed in stopping the press motion in response to the overload control signal $I_{OL}$.

At step 109 both the operations of steps 107 and 108 have been completed and all slide activity comes to rest. At this point the overload forces have been safely dissipated and the press may resume normal operation once the cause of the overload has been taken care of.

As can be seen from the foregoing description, this invention provides an improved hydraulic control system for indicating the presence of an overload in presses. The hydraulic control system of this invention determines the presence of an overload condition by measuring the force exerted on the die at any position during the press cycle. This is in contrast to the prior art, which only used a constant value for the tonnage capacity, and thus could not accurately determine the true maximum value of the capacity of the press and the die during any given part of the press cycle.

The system of the invention is equally applicable to single-point and multiple-point suspension presses. It may also be utilized in connection with a blank holder slide as well as the slide described above.

What is claimed is:

1. In a mechanical power press having a flywheel driven shaft and an eccentric fixed thereto, a pitman drivingly connected to said eccentric, a slide drivingly connected to said pitman, a die connected with said slide, and a clutch and brake interlock mechanism for arresting movement of said slide, the improvement comprising, in combination:

means for generating a first electrical signal having a value proportional to the force exerted on said die by said slide throughout the work stroke, means for generating a second electrical signal having a value proportional to the position of said slide throughout the work stroke, means for storing the maximum tonnage capacity values of the press at a multiplicity of slide positions throughout the work stroke, control means responsive to said second signal for retrieving the stored value representing the maximum tonnage capacity of the press at the slide position represented by said second signal, means for comparing said retrieved value with said value of first signal to determine whether the press is in an overload condition, and means responsive to the determination of an overload condition at any point in the work stroke for actuating said clutch and brake interlock mechanism to stop movement of said slide.

2. The combination of claim 1 in which said means for electrically indicating the force exerted on said die by said slide includes a hydraulic cylinder and piston arrangement; said arrangement including a pressure transducer for electrically indicating the fluid pressure inside said cylinder.

3. The improvement of claim 1 in which said means for electrically indicating the position of said slide includes an angular displacement transducer mounted on said eccentric shaft.

4. The combination of claim 1 wherein said storage means includes a microprocessor with associated memory, input and output ports with interface circuitry and all interconnections involved therein, said microprocessor being programmed to accept said maximum tonnage capacity values and store them in said memory in the form of a look-up table.

5. The combination of claim 4 wherein said microprocessor with associated memory, input and output ports with interface circuitry and all interconnections involved therein also serves as said control means and said comparing means, said microprocessor being programmed to accept said value of first signal, accept said value of second signal and use it as an index into said look-up table to retrieve the corresponding maximum tonnage value stored therein, compare said retrieved values with said value of first signal to determine whether the press is in an overload condition.

6. The combination of claim 5 wherein said microprocessor is also programmed to generate a control signal whenever the said press is found to be in an overload condition, said control signal being adapted to activate said clutch and brake mechanism to stop the movement of said slide.

7. The combination of claim 4 wherein said microprocessor also serves as said control means responsive to said second signal, said microprocessor being programmed to accept said value of second signal and use it as an index into said look-up table to retrieve the corresponding maximum tonnage value stored therein.

8. The combination of claim 7 wherein said comparing means includes a comparator, said comparator accepting said value of first signal and said retrieved maximum tonnage value at its input and comparing said accepted values to produce a control signal whenever said value of first signal exceeds said retrieved maximum tonnage value, said control signal being adapted to activate said clutch and brake mechanism to stop the movement of said slide.

9. The combination of claim 6 wherein said control signal is also adapted to relieve the fluid pressure between said hydraulic cylinder and piston in the event of an overload at any point in the work stroke.

10. In a mechanical press having a flywheel driven shaft, a pitman drivingly connected with said driven shaft, a slide coupled to said pitman, a die actuated by said slide, and a clutch and brake interlock mechanism for restricting movement of said slide, the improvement comprising, in combination a hydraulic piston and cylinder disposed between said slide and said pitman, an overload control valve in communication with said cylinder, said valve having a pressure transducer associated with it, said pressure transducer generating an electrical signal representing the fluid pressure generated inside said cylinder due to the motion of said slide, a rotational transducer in rotational communication with said driven shaft, said rotational transducer generating an electrical signal representing the position of said slide throughout the work stroke, means for storing the maximum tonnage capacity values of the press at a multiplicity of slide positions throughout the work stroke, control means responsive to said position indicating signal for retrieving the stored values representing the maximum tonnage capacity of the press at the slide position represented by said position signal, means for comparing said retrieved value with said value of said pressure signal to determine whether the press is in an overload condition, and means responsive to the determination of an overload condition at any point in the work stroke for actuating said clutch and brake interlock mechanism to stop movement of said slide.

11. The combination of claim 10 wherein said storage means includes a microprocessor with associated memory, input and output ports with interface circuitry and all interconnections involved therein, said microprocessor being programmed to accept said maximum tonnage capacity values and store them in said memory in the form of a look-up table.

12. The combination of claim 11 wherein said microprocessor also serves as said control means and comparing means, said microprocessor being programmed to accept said force indicating signal, accept said position indicating signal and use it as an index into said look-up table to retrieve the corresponding maximum tonage value stored therein, compare said retrieved value with said force indicating signal to determine whether the press is in an overload condition.

13. The combination of claim 12 wherein said microprocessor is also programmed to generate a control signal whenever the said press is found to be in an overload condition, said control signal being adatped to activate said clutch and brake mechanism to stop the movement of said slide.

14. The combination of claim 11 wherein said microprocessor also serves as said control means responsive to said position indicating signal, said microprocessor being programmed to accept said position indicating signal and use it as an index into said look-up table to retrieve the corresponding maximum tonnage value stored therein.

15. The combination of claim 14 wherein said comparing means includes a comparator, said comparator accepting said position indicating signal and said retrieved maximum tonnage value at its input and comparing them to produce a control signal whenever said force indicating signal has a value which exceeds said retrieved maximum tonnage value, said control signal being adapted to activate said clutch and brake mechanism to stop the movement of said slide.

16. The combination of claim 13 wherein said control signal is also adapted to relieve the fluid pressure between said hydraulic cylinder and piston in the event of an cverload at any point in the work stroke.

* * * * *